United States Patent [19]

Tatematsu et al.

[11] Patent Number: 4,901,396

[45] Date of Patent: Feb. 20, 1990

[54] ICE DISCHARGE APPARATUS OF ICE DISPENSER

[75] Inventors: Susumu Tatematsu; Yasumitsu Tsukiyama; Naoya Uchida, all of Toyoake City, Japan

[73] Assignee: Hoshizaki Electric Co., Ltd., Toyoake City, Japan

[21] Appl. No.: 302,437

[22] Filed: Jan. 26, 1989

[30] Foreign Application Priority Data

| | | | |
|---|---|---|---|
| Jan. 29, 1988 | [JP] | Japan | 63-9678[U] |
| Feb. 12, 1988 | [JP] | Japan | 63-16281[U] |
| Mar. 4, 1988 | [JP] | Japan | 63-28163[U] |

[51] Int. Cl.[4] ..... E05F 01/08

[52] U.S. Cl. ..... 16/76; 16/75; 16/307; 16/308; 62/344; 267/155; 267/180; 267/275

[58] Field of Search ..... 16/76, 77, 307, 308, 16/DIG. 36, 75; 267/248, 275, 273, 286, 155, 166, 180, 173, 179, 168; 62/344, 354

[56] References Cited

U.S. PATENT DOCUMENTS

| | | | |
|---|---|---|---|
| 240,815 | 5/1881 | Devore | 16/76 |
| 2,621,917 | 12/1952 | Landers | 267/155 |
| 2,772,876 | 12/1956 | McGuire | 267/275 |
| 3,942,334 | 3/1976 | Pink | 62/344 |
| 4,069,545 | 1/1978 | Holet | 16/49 |
| 4,524,438 | 6/1985 | Einhaus | 16/308 |
| 4,679,715 | 7/1987 | Hovinga | 62/344 |

*Primary Examiner*—Nicholas P. Godici
*Assistant Examiner*—James Miner
*Attorney, Agent, or Firm*—Brooks, Haidt, Haffner & Delahunty

[57] ABSTRACT

An ice discharging apparatus of an ice dispenser comprises an openable door normally urged resiliently to a closed state by means of a torsion coil spring and adapted to be openable by a door actuator under the control of a control apparatus. The torsion coil spring includes an intermediate coil portion substantially of a cylindrical form and at least one end coil portion having an inner diameter greater than an average diameter of the intermediate coil portion in the unloaded state. The torsion coil spring has at least one arm extending from an end of the coil spring and having an extension secured in contact with a stationary part of the apparatus or a part of the openable door at an intermediate portion thereof and subsequently bent to constitute an inactive portion in which an annular mounting member for mounting the torsion coil spring is formed at the free end thereof. The torsion coil spring includes at least one annular portion formed at an end of an arm extending from the spring, the annular portion being linked to an anti-drop wire ring member mounted on a stationary part of the ice discharging apparatus or on the openable door. The torsion coil spring is difficult to break. Fragments resulting from breakage is prevented from dropping into ice being discharged.

10 Claims, 9 Drawing Sheets

PRIOR ART

ICE DISCHARGE APPARATUS OF ICE DISPENSER

BACKGROUND OF THE INVENTION

1. Field of the Invention

The present invention generally relates to an ice discharging apparatus of an ice dispenser and more particularly to the ice discharging apparatus which is composed of a door closed under the action of a torsion coil spring and adapted to be opened by a door actuator. More specifically, the present invention concerns an improved structure of the torsion coil spring.

2. Description of the Related Art

In the hitherto known ice dispensers, a variety of doors for openably closing an ice discharging port are employed in combination with various types of door actuators. A typical structure of the prior art ice discharging apparatuses is shown in FIGS. 11, 12 and 13 of the accompanying drawings, which will be described below.

Referring to FIG. 11, there is shown a hitherto known ice dispensing apparatus, wherein reference numeral 2 denotes an ice storing chamber or box, 2*a* a discharge port, 3 a door actuator, 4 an openable door, 5 a solenoid, 5*a* a movable armature member, 6 a link, 7 a torsion coil spring, and 8 a supporting shaft on which the door 4 is rotatably or swingably mounted. In operation, assuming that the solenoid 5 is electrically energized by a control apparatus (not shown), the movable armature member 5*a* is magnetically attracted by the solenoid 5, as the result of which the openable door 4 which is pivotally connected to the movable armature member 5*a* by way of the link 6 is caused to rotate about the supporting shaft 8, whereby the ice passage or discharge port 2*a* leading to a dispensing port is set to the opened state. After a predetermined amount of ice has been discharged, the solenoid 5 is deenergized in an automatic manner by the control apparatus. At that time, the door 4 is rotated under the resilient restoring force of the torsion coil spring 7 to the state where the ice passage or port 2*a* is closed.

Referring to FIGS. 12 and 13, the torsion coil spring 7 as employed is of a substantially cylindrical form having a uniform coil diameter and coil turns wound closely to one another. Extending from the opposite ends of the torsion coil spring 7 are arm portions 7*b* and 7*c*, one of which has a hook secured to a stationary part of the ice storing box 2 with the other being fixed to the door 4.

More specifically, a main coil portion of the torsion coil spring 7 is mounted around the supporting shaft 8, while the hook of the arm portion 7*b* is fitted in a retaining hole 2*c* formed in a base plate of the door actuator 5 with the other arm portion 7*c* being bonded to the door 4, as is shown in FIG. 11.

When the door 4 is opened, the torsion coil spring 7 is placed under a load through the arm portions 7*b* and 7*c*, resulting in that the coil diameters (inner and outer diameters) are reduced. When the door 4 is closed, the load is substantially removed, allowing the coil portion to resume the original diameter.

As will be appreciated from the above description, in the hitherto known ice discharging apparatus of the ice dispenser including the door adapted to be opened by the door actuator equipped with the control means, the torsion coil spring serving for closing the door 4 once opened for discharging a predetermined amount of ice is constituted by a coil having a uniform diameter and is mounted around the supporting shaft (which may be a shaft secured unrotatably or mounted rotatably together with the door 4) which has a smaller diameter than the inner diameter of the coil of the torsion coil spring. Consequently, when a load is applied due to the opening operation of the door 4, the inner coil surface of the torsion coil spring 7 is not only brought into contact with the outer surface of the supporting shaft 8, but also caused to move or slide in contact with the surface of the supporting shaft (because the torsion coil spring is twisted in the rotating direction of the door 4 relative to the stationary part of the ice dispensing apparatus). In that case, both the end portions of the torsion coil spring are not only subjected to the maximum stress, but also undergo wear or abrasion because of the sliding movement mentioned above, giving rise to a problem that the torsion coil spring is likely to be broken particularly at the end coil portions which are in contact with the supporting shaft 8 as indicated at D. Moreover, another problem will concurrently arise that the end portions of the coil as broken away drop into ice being discharged, presenting a danger to an ice consumer.

SUMMARY OF THE INVENTION

In the light of the problems of the prior art described above, a general object of the present invention is to provide an improved structure of a torsion coil spring for an ice discharge apparatus of an ice dispenser provided with an openable door adapted to be opened by a door actuator under the control of a control apparauts, which door being resiliently urged to the closed state under the influence of the torsion coil spring.

It is a first object of the present invention to provide an ice discharge apparatus including an openable door and a torsion coil spring used for urging resiliently the door to the closed position, which spring has a structure improved so that the possibility of breakage of the coil is reduced to a minimum.

It is a second object of the present invention to provide an ice discharge apparatus including an openable door provided with a torsion coil spring of such an improved structure that even if the spring is broken, the resulting coil pieces or fragments are positively prevented from dropping into ice being discharged to thereby exclude any danger to the ice consumer.

In view of the first object mentioned above, there is provided according to an aspect of the present invention an ice discharging apparatus of an ice dispenser, comprising an openable door normally urged resiliently to a closed state by means of a torsion coil spring and adapted to be openable by a door actuator under the control of a control apparatus, wherein the torsion coil spring includes an intermediate coil portion substantially of a cylindrical form and at least one end coil portion having an inner diameter greater than an average diameter of the intermediate coil portion in the unloaded state.

In a version of the torsion coil spring structure mentioned above, the end coil portion may be provided only on the side of an arm designed to engage with the openable door.

In view of the second object mentioned above, there is provided according to a second aspect of the present invention an ice discharging apparatus of an ice dispenser, comprising an openable door normally urged resiliently to a closed state by a torsion coil spring and adapted to be opened by a door actuator under the control of a control apparatus, wherein the torsion coil spring has at least one arm extending from an end of the coil spring and having an extension secured in contact with a stationary part of the apparatus or a part of the openable door at an intermediate point of the arm and subsequently bent to constitute an inactive portion in which an annular mounting member for mounting the torsion coil spring is formed.

Further, in view of the second object mentioed above, there is provided according to a third aspect of the present invention an ice discharging apparatus of an ice dispenser, comprising an openable door normally urged resiliently to a closed state by means of a torsion coil spring and adapted to be opened by a door actuator under the control of a control apparatus, wherein the torsion coil spring includes at least one annular portion formed at an end of an arm extending from the spring, the annular portion being linked to an anti-drop wire ring mounted on a stationary part of the apparatus or on a part of the openable door.

In the structure of the apparatus according to the first aspect of the present invention, the torsion coil spring is mounted around a supporting shaft for the openable door for ensuring the positioning of the spring. When a load is applied to the torsion coil spring upon opening of the door by the door actuator, stress is produced because of the twisting of the spring particularly in the end coil portions from which the arms extend, respectively. However, by virtue of such structure that the end coil portions have a greater diameter than that of the intermediate or center portion of the spring, the end portions are prevented from contacting with the supporting shaft with only the intermediate coil portion being brought into contact with that shaft. In this way, the coil portion susceptible to undergo stress is seperated from the coil portion likely to wear due to the sliding contact with the surface of the supporting shaft, as the result of which the torsion coil spring is rendered difficult to break, whereby the possibility of breakage thereof is significantly reduced.

In this conjunction, it is further noted that even when the torsion coil spring is broken, the coil pieces or fragments resulting from the breakage can be held by the supporting shaft because the fragments still retain the coil configuration, whereby the possibility that the coil fragments might drop to be mixedly added to the ice being discharged can be positively excluded.

In the structure of the apparatus according to the second aspect of the present invention, the torsion coil spring is equally mounted on and around the supporting shaft, wherein one annular end of one arm of the spring is mounted on a stationary part of the ice dispenser or the ice discharging apparatus while the other annular end of the other arm is mounted on the openable door. However, since at least one annular securing portion is formed at the end of the inactive portion of the associated arm which extends from the junction where the arm is bonded to the stationary part or the openable door and at which the arm is bent, a major part of the stress produced upon rotation of the door is developed at the junction and exerts substantially no influence to the inactive portion. In general, in the torsion coil spring, breakage tends to occur at the foot portion of the arm and the bonded portion or junction which are likely to fatigue under stress and the coil portion susceptible to abrasion due to the sliding contact with the supporting shaft under torsion. However, in the structure of the apparatus according to the second aspect of the second invention, the annular securing portion formed in the inactive portion is protected against the breakage due to fatigue. Thus, any fragment of the spring resulting from the breakage can be prevented from dropping in ice being discharged. In other words, even when the torsion coil spring realized according to the second aspect of the invention is broken, the annular securing portion is held by the stationary part or the openable door while the coil portion can remain as mounted on the supporting shaft.

In the structure of the apparatus according to the third aspect of the invention in which the annular portion is provided at an end of an arm of the torsion coil spring and linked to the anti-drop wire ring mounted on a part of the apparatus or the openable door, the coil fragments resulting from the breakage of the spring can be held by the anti-drop wire ring and the supporting shaft, respectively, being thus prevented from dropping into ice being discharged.

BRIEF DESCRIPTION OF THE DRAWINGS

The above and other objects, features and advantages of the present invention will be more apparent from the following description taken in conjunction with the preferred embodiments thereof given by way of example only and shown in the annexed drawings, in which.

DESCRIPTION OF THE PREFERRED EMBODIMENTS

Now, the invention will be described in detail in conjunction with the preferred and exemplary embodiments thereof by reference to the accompanying drawings.

Figure 1:
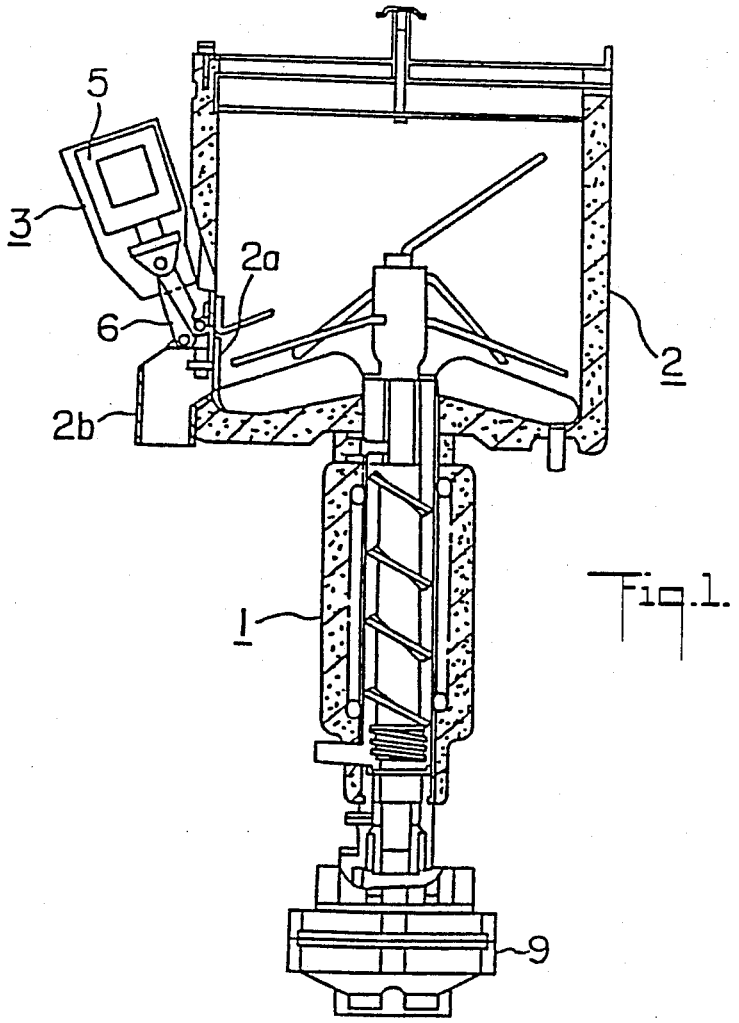
FIG. 1 is an elevational view, in partial section, of an ice dispenser equipped with an ice discharging apparatus according to the present invention.

Referring to FIG. 1, an ice storing chamber or box 2 is disposed on an ice making mechanism generally designated by a numeral 1. An opening or port 2*a* is formed in a side wall of the ice storing chamber 2 at a lower portion thereof. An ice chute 2*b* is mounted in association with the port (opening) 2*a*.

Figure 2:
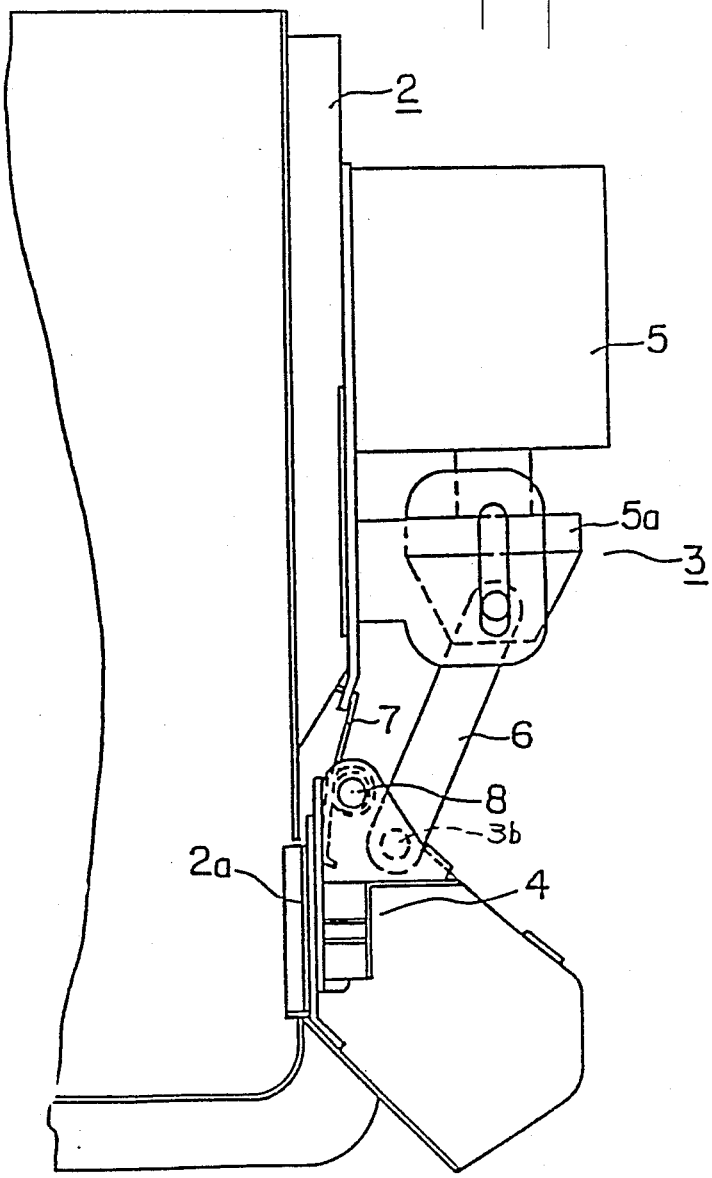
FIG. 2 is an enlarged view of a main portion of the apparatus shown in FIG. 1, illustrating schematically a structure of the invention.

Referring to FIG. 2 along with FIG. 1, a door 4 is disposed at the port 2*a* and constitues an ice discharging apparatus in cooperation with a door actuator 3 adapted to open rotatably the door 4. The door actuator 3 is fixedly mounted on a side wall of the ice storing box 2 and is composed of a solenoid 5 whose electrical energization/deenergization is controlled by a control apparatus (not shown), a movable armature member 5*a*, a link member 6 pivotally connected to the movable armature member 5*a* to serve for transmitting an attracting force to the openable door 4, and a supporting shaft 8 on which the door 4 is mounted to be rotatable or swingable under the action of the door actuator 3, as can be seen in FIG. 2. In this manner, the door 4 mounted rotatably on the shaft 8 is operatively connected to the solenoid 4 by way of the link 6, wherein the door 4 is formed with a hole in which a stud 3*b* is rotatably fitted.

Figure 3:
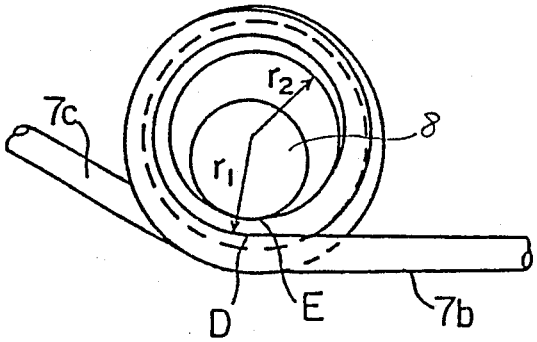
FIG. 3 is an end view of a torsion coil spring realized according to the first embodiment of the present invention.
Figure 4:
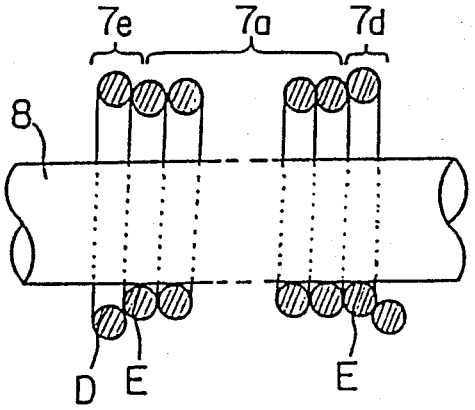
FIG. 4 is a front view showing in section the torsion coil spring according to the first embodiment of the invention.

The door 4 is normally urged resiliently to the state closing the opening or port 2*a* under the influece of a torsion coil spring 7. FIGS. 3 and 4 show in detail an improved structure of the torsion coil spring 7 according to a first embodiment of the present invention.

Referring to FIGS. 3 and 4, the torsion coil spring 7 includes a center or intermediate coil portion 7*a*, end coil portions 7*d* and 7*e*, and arms 7*b* and 7*c* which may be additionally provided with a hook (FIG. 2), when occassion requires. As is illustrated in FIG. 3, each of the end coil portions 7*d* and 7*e* has a radius $r_1$ greater than that $r_2$ of the intermediate coil portion 7*a*. Further, the end coil portion 7*d*, 7*e* forms at least one complete turn of the coil in the unloaded state. In the case of the illustrated torsion coil spring, the intermediate coil portion 7*a* has starting points E each located at the second turn from the outermost one, wherein the end coil portion 7*d*, 7*e* is wound spirally inwardly toward the associated starting point E.

The radius $r_1$ (or diameter) of the end coil portion 7*d*, 7*e* is determined in dependence on the difference between the inner diameter of the intermediate coil portion 7*a* and the outer diameter of the supporting shaft 8 and an angle of torsion in the loaded state. It is preferred that in the unloaded state, the boundary portion between the arm 7*b*, 7*c* and the end coil portion 7*d*, 7*e* has a gap of at least one third of the diameter of a wire material forming the coil relative to the supporting shaft. In other words, the end coil portion 7*d*, 7*e* should have an inner diameter which is at least greater than an average diameter of the intermediate coil portion 7*a* in the unloaded state. With the phrase "average diameter", it is intended to mean a mean value of the inner and outer diameters of that coil portion.

Next, description will be turned to the operation of the ice discharging apparatus according to the first embodiment of the present invention.

Upon power-on of the ice making machine, icing water is fed into the ice making machine shown in FIG. 1 by way of a feed water valve (not shown), and ice making operation is started with a compressor (not shown) and a drive motor 9 being activated. In the course of the ice making operation, ice pellets as manufactured by the ice making mechanism 1 are stored within the ice storing box 2.

When an ice dispense request signal is inputted to the control apparatus (not shown), the solenoid 5 is electrically energized by the control apparatus to attract the movable armature member 5*a*, as the result of which the door 4 is rotated about the supporting shaft 8 by means of the link 6 pivotally connected to the movable armature member 5*a*. The port 2*a* of the ice storing box 2 is thus opened, allowing ice to be discharged outwardly from the ice storing box 2.

Upon deenergization of the solenoid 5 by the control apparatus, the door 4 is rotated under the influence of the restoring force of the torsion coil spring 7 as well as gravity of the door 4 to the position to close the port 2*a*. Thus, the ice discharge cycle comes to an end. In this conjunction, it is to be noted that the torsion coil spring 7 is imparted with the restoring force of such magnitude which is sufficiently large not only for operating the door 4 but moving it to the closed state while overcoming the pressure exerted by ice within the storing chamber 2.

Every time the ice dispensing operation is effected, torsional (twisting) moment is produced in the torsion coil spring 7 about the center axis thereof by way of the arms 7*b* and 7*c*. As the result, fatigue due to stress tends to occur accumulatively in the end coil portions 7*d* and 7*e* corresponding to the foot portions of the arm 7*b* and 7*c*. Additionally, at the location where the torsion coil spring 7 is brought into contact with the supporting shaft 8, abrasion or wear will progressively increase because of the sliding contact between the torsion coil spring 7 and the supporting shaft 8 due to reduction in the diameter of the torsion coil spring 7 under the torsion.

However, in the improved structure of the torsion coil spring 7 according to the first embodiment of the present invention, the coil portion which is likely to undergo abrasion or wear due to the decrease in the diameter of the coil spring and the sliding contact with the supporting shaft 8 is separated from the end coil portions 7*d* and 7*e* where fatigue due to stress is likely to be accumulated. Thus, it is possible to extend significantly the use life of the torsion coil spring 7.

Further, even when the torsion coil spring 7 should unfortunately be broken due to wear or abrasion, the coil fragments resulting from the breakage each has at least one turn of coil. Accordingly, there can not arise the problem that the separated end coil portions are released and drop into ice being transported outwardly. In this manner, the danger that the coil fragments resulting from breakage of the intermediate coil portion might drop into ice being discharged can positively be removed.

In addition, it should be mentioned that in the case of the torsion coil spring 7 mounted on the supporting shaft 8 in contact therewith, only one end coil portion having the inner diameter greater than the average diameter of the intermediate coil portion may be provided on the side of the coil end portion engaged with the rotatable door for the purpose of increasing the durability of the torsion coil spring.

Figure 5:
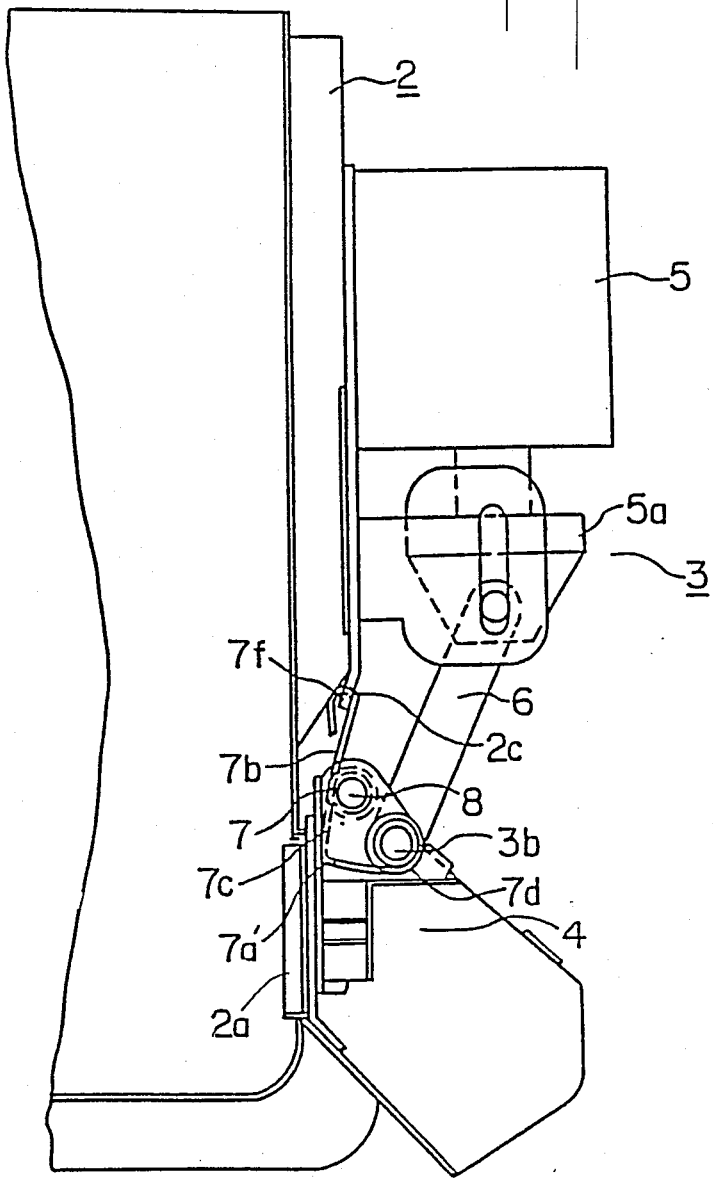
FIG. 5 is an enlarged view of a main portion of the apparatus shown in FIG. 1 and illustrates schematically a structure of the ice discharging apparaus according to a second embodiment of the present invention.

Next, description will be made of a second embodiment of the present invention by referring to FIGS. 5, 6 and 7. The ice discharging apparatus shown in FIG. 5 has a structure substantially identical with that shown in FIG. 2. Accordingly, the same or equivalent components and members are designated by the like reference numerals, and repeated description of the apparatus shown in FIG. 5 is omitted.

Difference of the second embodiment of the present invention from the first embodiment described hereinbefore resides in the structure of the spring 7 as well as the manner in which the spring 7 is mounted. The structure of the torsion coil spring 7 serving for urging resiliently the door 4 to the position to close the opening or port 2*a* is shown in detail in FIGS. 6 and 7.

Referring to these figures, the torsion coil spring 7 has a pair of arms 7*b* and 7*c* at both ends, respectively, wherein the arm 7*c* is secured or bonded to the door 4 at a junction 7*a'* and subsequently bent to form an extension or inactive portion 7*f* which has a free end formed with a mounting or engaging member 7*d*. The coil portion of the torsion coil spring 7 is fitted around the supporting shaft 8 by which the door 4 is rotatably supported. The other arm 7*b* of the torsion coil spring 7 has a ring-like hook 7*f* formed at a free end thereof. By inserting the hook 7*f* in a hole 7*c* formed in a mounting plate for the door actuator 3 at a lower end portion thereof, the arm 7*b* of the spring 7 can be secured. On the other hand, the arm 7 of the torsion coil spring 7*c* is bonded to the door 4 at the junction 7*a'* and has the bent inactive portion 7*f* extending from the junction 7*a'*. The inactive portion 7*f* is formed with an annular mounting member 7*d* at the free end, which member 7*d* is fitted around the stud 3*b* of the link 6.

Figure 6:
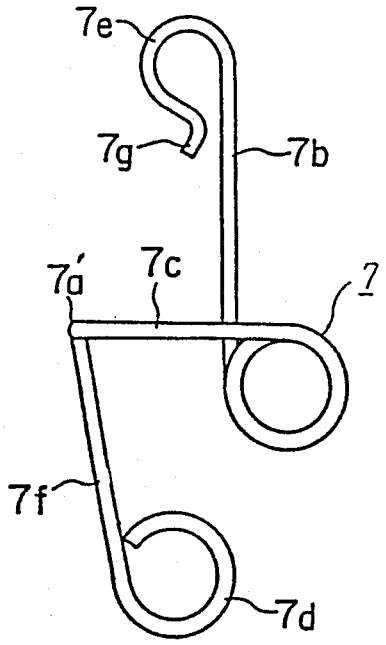
FIGS. 6 and 7 are end views of a torsion coil spring according to the second embodiment of the present invention, as viewed in different directions, respectively.
Figure 7:
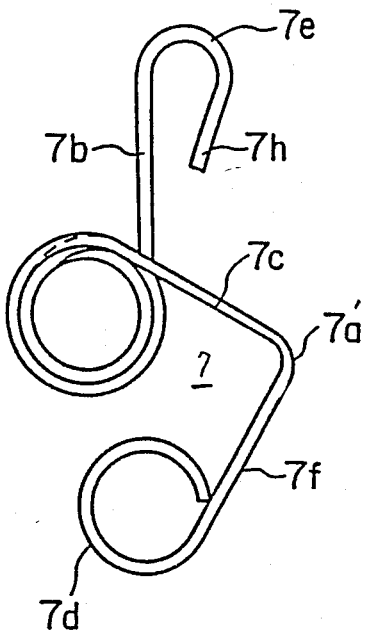

Additionally, in the initial form of the torsion coil spring 7, the free end portion 7*g* of the hook formed in the arm 7*c* should preferably be bent outwardly, as illustrated in FIG. 6, for facilitating insertion of the hook 7*e* in the engaging hole 2*c*. After insertion, the bent portion 7*g* is straightened, as shown at 7*h* in FIG. 7, and subsequently deformed into a ring-like shape by means of a suitable tool.

Every time the operation of the ice dispenser is effected in the manner described hereinbefore, torsional moment is applied to the coil spring 7 about the center axis thereof by way of the arms 7*b* and 7*c*, as the result of which stress is produced particularly in the arms 7*b* and 7*c* as well as at the junction 7*a'* in addition to abrasion of the coil portion because of sliding movement thereof relative to the supporting shaft 8. As the fatigue due to the stress and the abrasion are progressively accumulated after a series of the ice dispensing operations, breakage of the spring may finally occur at the portions mentioned above. However, in the illustrated torsion coil spring according to the second embodiment, the annular mounting member 7*d* formed integrally with the inactive portion 7*f* and thus free of any stress is fitted around the stud 3*b* of the link 6. Thus, the mounting portions 7*d* and 7*e* can remain in the state held by the stud 3*b* and the hole 2*c* while the coil portion continues to be supported on the shaft 8, even when the breakage occurs as mentioned above. Thus, any fragments resulting from the breakage are positively prevented from dropping into ice being discharged.

In the foregoing description, it has been assumed that the inactive portion 7*f* is provided only in association with the arm 7*c*. However, such inactive portion 7*f* may be provided for the arm 7*b* as well to the similar effect. Of course, both arms 7*b* and 7*c* may be provided with respective inactive portions 7*f* to further enhance the intended effect.

As will now be appreciated from the above, in the torsion coil spring according to the second embodiment of the invention in which the annular mounting member is formed integrally with the inaction portion defined by a bent extension of the arm of the coil spring extending from the junction at which the arm is bonded to a stationary part of the apparatus or the door, a major part of stress produced in the torsion coil spring due to the rotation of the door is born by the junction and excluded from the bent inactive portion. Accordingly, even when breakage occurs in the arms, the foot portions thereof or the junction which are likely to fatigue under the stress or the coil portion subjected to abrasion due to the sliding contact with the supporting shaft, the coil portion continues to be supported on the shaft 8 with the annular mounting members remaining in the states supported by the stud 3*b* of the link 6 and the engaging hole 2*c*, whereby dropping of any fragments resulting from the breakage into ice being carried outwardly can be prevented.

Needless to say, the torsion coil spring according to the second embodiment of the invention may be combined with the structure of the spring described hereinbefore in conjunction with FIGS. 2, 3 and 4. In that case, the advantage that the breakage of the spring is difficult to occur can be obtained in addition to the effects mentioned above.

Next, a third embodiment of the present invention will be described by referring to FIGS. 8, 9A, 9B and 10. In the case of the third embodiment of the invention, the structure and the operation of the ice discharging apparatus are essentially identical with those of the apparatus shown in FIGS. 2 and 5. Accordingly, the same and equivalent components are designated by the like reference symbols and repeated description is omitted. The third embodiment differs from the first and second embodiments of the invention with regard to the structure of the torsion coil spring 7 and the manner in which it is mounted. The structure of the torsion coil spring according to the third embodiment of the invention for urging resiliently the door 4 to the position to close the port 2*a* is shown in detail in FIGS. 9A, 9B and 10.

Figure 8:
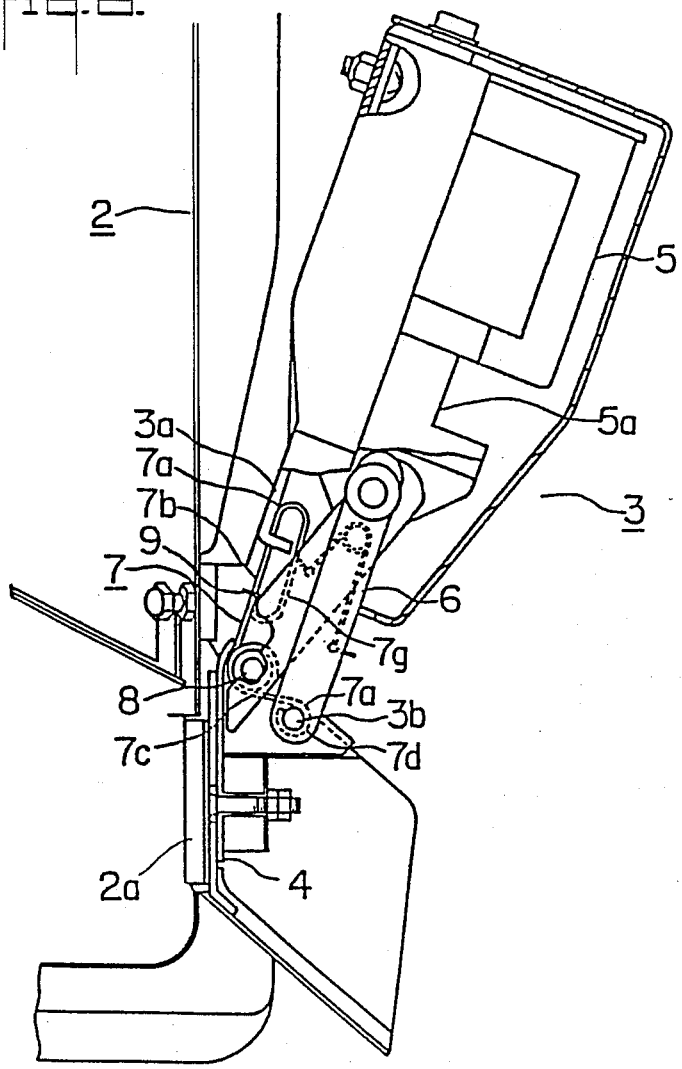
FIG. 8 is a view similar to FIGS. 2 and 5, illustrating schematically a structure of the ice discharging apparatus according to a third embodiment of the invention.

Referring to FIG. 8, the torsion coil spring 7 has a coil portion inserted around the supporting shaft 8 for the openable door 4, while the arm 7*b* is bonded at a free end thereof to a stationary part of the apparatus or the door actuator with the other arm 7*c* being mounted on the stud 3*b* of the link 6.

Figure 9A:
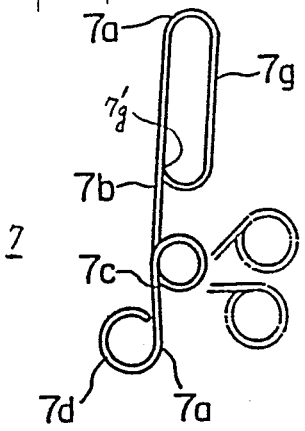
FIGS. 9A and 9B are end views showing, respectively, a torsion coil spring and an anti-drop wire member according to the third embodiment of the invention.
Figure 9B:
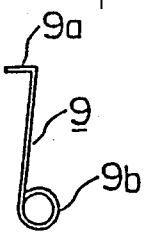
Figure 10:
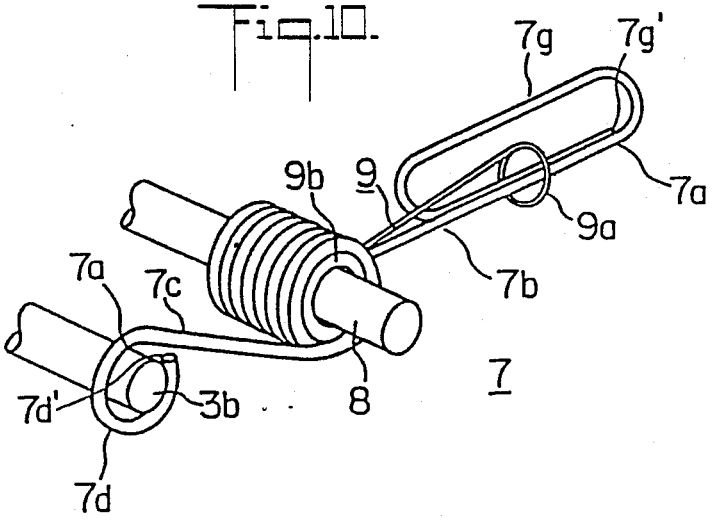
FIG. 10 is a perspective view showing a manner in which the torsion coil spring and the anti-drop wire member according to the third embodiment of the invention are assembled.
Figure 11:
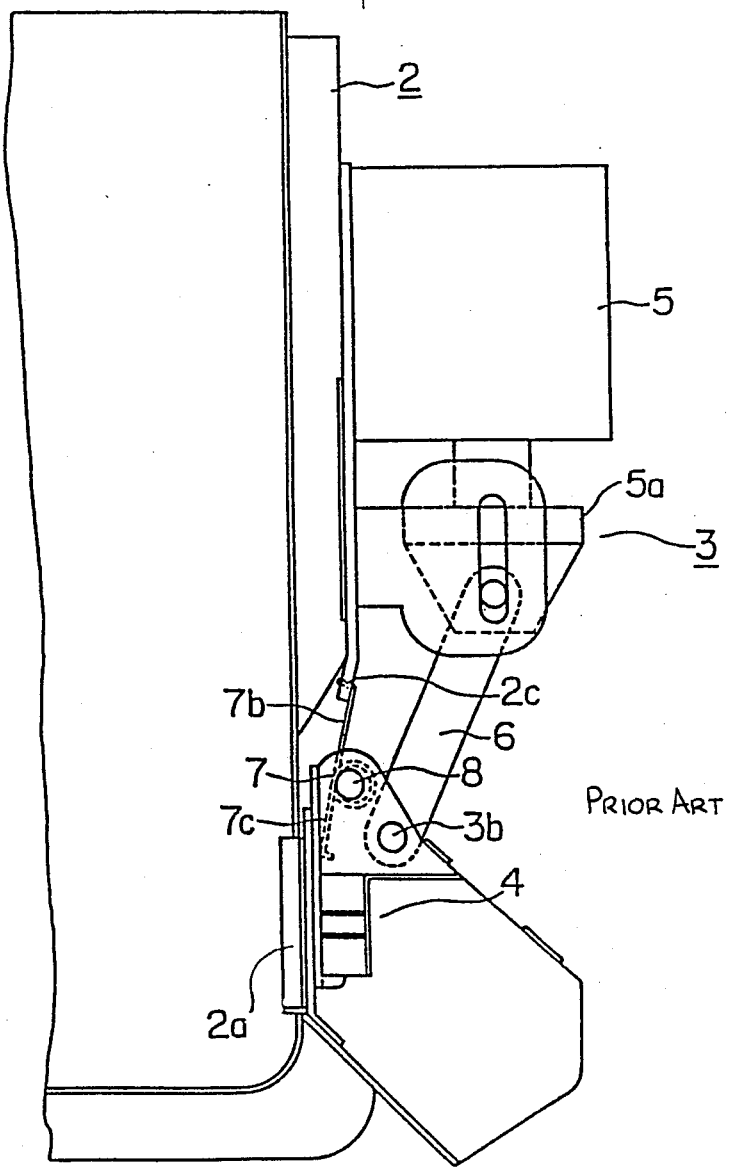
FIG. 11 is a partially sectioned elevational view of a prior art ice discharging apparatus of a known ice dispenser.
Figure 12:
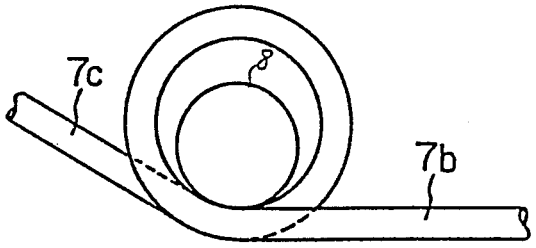
FIGS. 12 and 13 are, respectively, an end view and a front view showing partially in section a conventional torsion coil spring used in the ice dispensing apparatus such as the one shown in FIG. 11.
Figure 13:
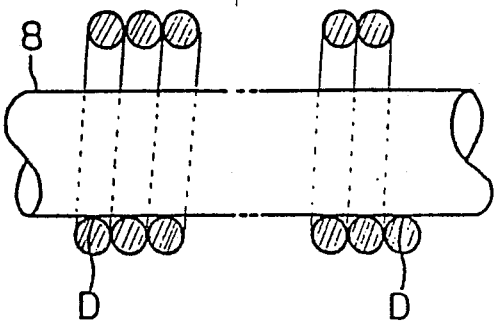
PRIOR ART Fig. 13.

Referring to FIGS. 9A and 10, an annulus 7*g* of one complete turn is formed in the arm 7*b* by tightly contacting the free end 7*g'* thereof to an intermediate portion of the arm 7*b*. On the other hand, the arm 7*c* is provided with a mounting ring 7*d* at the free end portion, the mounting ring 7*d* being fitted around the stud 3*b* of the link 6. The resilient repulsing force of the torsion coil spring 7 acts between a stationary part of the door actuator 3 and the stud 3*b* mounted on the door 4 for pivotal connection with the link 6.

Referring again to FIGS. 9B and 10, an anti-drop wire member 9 has a ring 9*a* formed at one end and a mounting annulus 9*b* formed at the other end. The ring 9*a* is formed annularly in a plane orthogonal to the axis of the wire 9. This ring 9*a* is slidably engaged with the arm 7*b* of the torsion coil spring 7. The mounting annulus 9*b* is mounted around the shaft 8 together with the coil portion of the torsion coil spring 7.

Since the supporting shaft 8 is scarcely moved, the antidrop wire undergoes little abrasion. Thus, the mounting annulus 9*b* can not be broken. Further, by forming the mounting annulus 9*b* with a number of turns and disposing it inside of the torsion coil spring in overlapping relation, the structural stability of the torsion coil spring 7 can be increased.

In the case of the illustrated spring structure, the ring 7*g* formed in the arm 7*b* at the free end portion thereof is slidably engaged with the ring 9*a* of the anti-drop wire member 9. It should however be understood that the similar effects can be obtained by using the anti-drop wire member 9 in combination with the mounting annulus 7*d* of the arm 7*c*. Of course, application of the anti-drop wire member 9 to both the arms 7*b* and 7*c* can further enhance the intended effects.

In the torsion coil spring according to the third embodiment of the invention in which an annulus is formed at least in one arm of the spring and engaged with the ring of the anti-drop wire member mounted on a stationary part of the apparatus or the door, fragments of the spring resulting from breakage thereof at the foot portion of the arm or other portions likely to be broken can be prevented from dropping into a stream of ice being discharged by virtue of the action of the anti-drop wire member 9.

It should be mentioned that the structure of the torsion coil spring described hereinbefore in conjunction with FIGS. 3 and 4 can be adopted as well. In that case, the effect of the difficult breakage of the spring can be additionally obtained.

In the foregoing, the present invention has been described in connection with the preferred embodiments only for the illustrative purpose. It should however be appreciated that many modifications, combinations and equivalents can readily to occur to those skilled in the art without departing from the spirit and scope of the invention.

What is claimed is:

1. An ice discharging apparatus of an ice dispenser, comprising an openable door normally urged resiliently to one of closed and opened states by means of a torsion coil spring and biased to the other of the closed and opened states by a door actuator under the control of a control apparatus, said torsion coil spring including an intermediate coil portion, and at least one coil end portion extending therefrom, wherein under an unloaded condition, said intermediate coil portion is in the form of a substantially cylindrical form and said at least one coil end portion has an inner diameter greater than an average diameter of said intermediate coil portion.

2. An apparatus according to claim 1, wherein said end coil portion is formed on the side of an arm of said torsion coil spring at which the latter is engaged with said door.

3. An apparatus according to claim 1, wherein said torsion coil spring includes two end coil portions each having a greater inner diameter than the average diameter of said intermediate coil portion, one of said end coil portions being formed on the side of an arm of said torsion coil spring engaging with said door, and the other of said end coil portions being formed on the side of an arm mounted on a stationary part of said door actuator.

4. An apparatus according to claim 1, wherein said end coil portion defines at an outermost turn thereof a gap relative to a supporting shaft on which said torsion coil spring is mounted, said gap being at least one third of a diameter of a wire material forming said torsion coil spring.

5. An ice discharging apparatus of an ice dispenser, comprising an openable door normally urged resiliently to a closed state by a torsion coil spring and adapted to be opened by a door actuator under the control of a control apparatus, wherein said torsion coil spring has at least one arm extending from an end of said torsion coil spring having an extension secured in contact with a stationary part of said ice discharging apparatus or an extension with an intermediate portion thereof secured in contact with a part of said openable door and subsequently bent to constitue an inactive portion at which a mounting member for mounting said torsion coil spring is formed.

6. An apparaus according to claim 5, wherein said torsion coil spring under an unloaded condition includes an intermediate coil portion substantially of a cylindrical form and at least one coil end portion having an inner diameter greater than an average diameter of said intermediate coil portion.

7. An apparatus according to claim 6, wherein said end coil portion defines at an outermost turn thereof a gap relative to a supporting shaft on which said torsion coil spring is mounted, said gap being at least one third of a diameter of a wire material forming said torsion coil spring.

8. An ice discharging apparatus of an ice dispenser, comprising an openable door normally urged resiliently to a closed state by means of a torsion coil spring and adapted to be opened by a door actuator under the control of a control apparatus, wherein said torsion coil spring includes at least one annular portion formed at an arm extending from said spring, said annular portion being linked to an anti-drop wire ring mounted on a stationary part of either said ice discharging apparatus or said openable door.

9. An apparatus according to claim 8, wherein said torsion coil spring under an unloaded condition includes an intermediate coil portion substantially of a cylindrical form and at least one coil end portion having an inner diameter greater than an average diameter of said intermediate coil portion.

10. An apparatus according to claim 9, wherein said end coil portion defines at an outermost turn thereof a gap relative to a supporting shaft on which said torsion coil spring is mounted, said gap being at least one third of a diameter of a wire material forming said torsion coil spring.

* * * * *

UNITED STATES PATENT AND TRADEMARK OFFICE

CERTIFICATE OF CORRECTION

PATENT NO. : 4,901,396

DATED : February 20, 1990

INVENTOR(S) : S. Tatematsu et al

It is certified that error appears in the above-identified patent and that said Letters Patent is hereby corrected as shown below:

Col. 3, line 37, "sepe" should read --sepa- --;

Col. 4, line 36, after "the" insert --ice discharging apparatus according to a first embodiment of the--;

Col. 5, line 33 "influece" should read --influence--;

Col. 7, line 29, "7" should read --7c-- and "7c" should read --7--;

Col. 10, line 19, after "spring" insert --, said arm--; after "having" insert --either--

Signed and Sealed this

Thirtieth Day of April, 1991

*Attest:*

HARRY F. MANBECK, JR.

*Attesting Officer*

*Commissioner of Patents and Trademarks*